US008004461B2

(12) United States Patent
Kim

(10) Patent No.: US 8,004,461 B2
(45) Date of Patent: Aug. 23, 2011

(54) MULTI-FUNCTIONAL SYSTEM FOR EXTENDING AND MODULATING 130DBM FREQUENCY OF GPS TERMINAL FOR LIFE JACKET

(76) Inventor: Jung Sun Kim, Seoul (KR)

( * ) Notice: Subject to any disclaimer, the term of this patent is extended or adjusted under 35 U.S.C. 154(b) by 449 days.

(21) Appl. No.: 12/083,617

(22) PCT Filed: Oct. 16, 2006

(86) PCT No.: PCT/KR2006/004182
§ 371 (c)(1),
(2), (4) Date: Apr. 16, 2008

(87) PCT Pub. No.: WO2007/046603
PCT Pub. Date: Apr. 26, 2007

(65) Prior Publication Data

US 2010/0149027 A1 Jun. 17, 2010

(30) Foreign Application Priority Data

Oct. 17, 2005 (KR) ..... 10-2005-0097572

(51) Int. Cl.
*G01S 19/48* (2010.01)

(52) U.S. Cl. ..... 342/357.31

(58) Field of Classification Search ..... 342/357.01–357.17, 357.2–357.78
See application file for complete search history.

(56) References Cited

U.S. PATENT DOCUMENTS

| | | | | |
|---|---|---|---|---|
| 4,232,389 | A * | 11/1980 | Loiler | 455/3.02 |
| 5,619,212 | A | 4/1997 | Counselman, III | |
| 6,222,484 | B1 * | 4/2001 | Seiple et al. | 342/357.55 |
| 6,747,597 | B2 * | 6/2004 | Choi | 342/357.1 |
| 2001/0049241 | A1 | 12/2001 | McClure et al. | |
| 2005/0012663 | A1 * | 1/2005 | Audren et al. | 342/357.07 |

FOREIGN PATENT DOCUMENTS

KR 10 2005 0049455 A 5/2005

* cited by examiner

*Primary Examiner* — Thomas H Tarcza
*Assistant Examiner* — Nga X Nguyen
(74) *Attorney, Agent, or Firm* — Park & Associate IP Law, P.C.

(57) ABSTRACT

Disclosed is a complex multifunction system of a frequency band (130 dBm) frequency extension modulation of a GPS terminal in a life jacket which is used when there is an accident at sea, at a ship or at an airplane. The system comprises a body including a front plate which transmits and receives a frequency transferred from the GPS terminal in a life jacket in a process of introducing and sharing a coupling scheme with interspace-VLBI in frequency band 130 dBm, and a rear plate which is in contact with a tag of an HDX frequency extension modulation; a head unit for attaching a iris on a head of the body and supporting a frequency propagation amplification transmission of a microstrip fetch antenna; and a location based service (LBS) attached to a middle portion of the front plate of the body or a head unit, having a function of transmitting an emergency rescue signal and converting the signal into a multi-language voice information service.

6 Claims, 11 Drawing Sheets

GPS satellite signal

Radiation patterns of GPS antenna.
(a) E_field pattern (b) H_feild pattern central frequency change : +10.23 MHz central frequency change: -10.23MHz Output after changing central frequency View showing a frequency band (130dBm) frequency extension and modulation process Change of normalized impedance in TM10 mode and TM01 mode, (a) amplitude Change of normalized impedance in TM10 mode and TM01 mode, (b) phase Reflective loss result in simulation test and experiment Axis ratio bandwidth result in simulation test and experiment FCC circuit output waveform

MULTI-FUNCTIONAL SYSTEM FOR EXTENDING AND MODULATING 130DBM FREQUENCY OF GPS TERMINAL FOR LIFE JACKET

TECHNICAL FIELD

The present invention relates to a frequency band (130 dBm) extension and modulation complex multifunction system of a GPS terminal for a life jacket, which is used when there is an accident at sea, at a ship or at an airplane. And, more specifically, the present invention relates to a frequency band (130 dBm) extension and modulation complex multifunction system, which has functions of an HDX frequency extension modulation of an RFID using an interspace-VLBI (a position tracking terminal capable of tracking a position of a victim at sea by communicating a wireless signal with GPS satellite, and in the case that the GPS terminal having a location tracking terminal capable of tracking a position of a victim in the sea by transmitting and receiving a wireless signal to and from the GPS satellite and transmitting an emergency rescue signal when wearing the jacket.

BACKGROUND ART

There is no conventional art related to a frequency band 130 dBm frequency extension and modulation complex multifunction system of a GPS terminal for a life jacket. However, there are conventional arts that are similar in each of product function in configuring the GPS terminal of the present invention, such as a radio wave amplification technology for an HDX frequency extension and modulation of frequency band 130 dBm setting section and RFID in a method for coupling with interspace ?VLBI (Very Long Baseline Interferometry), a frequency micro wave amplification transmission technology of a microstrip fetch antenna having an Iris in an antenna form, and a technology where a frequency of an urgent rescue signal is converted into a multi-language voice information service and which is connected to a location-based service (LBS) technology. Examples of such technologies include a registered Korean Utility Model Laid-Open No. 1955-0003637 (published on Apr. 17, 1955) entitled "Frequency modulator"? (hereinafter, referred to as a conventional art 1-1), a registered Korean Utility Model Laid-Open No. 1989-001907 (published on May 30, 1989) entitled "Apparatus and method for modulating bandwidth compression frequency"? (hereinafter, referred to as a conventional art 1-2), a registered Korean Utility Model Laid-Open No. 2003-0051597 (published on Jun. 25, 2003) entitled "RFID tag installation structure, RFID tag installation method and RFID tag communication method"? (hereinafter, referred to as a conventional art 2-1), a registered Korean Utility Model Laid-Open No. 10-2005-0051210 (published on Jun. 1, 2005) entitled "Message processing method Frequency modulator"? (hereinafter, referred to as a conventional art 2-2), a registered Korean Utility Model Laid-Open No. 10-2004-0028834 (published on Apr. 3, 2004) entitled "Electronic tag read system using mobile communication terminal"? (hereinafter, referred to as a conventional art 2-3), a registered Korean Utility Model Laid-Open No. 10-2002-0342510 (published on Jun. 28, 2002) entitled "Flip type terminal having microstrip fetch antenna for GPS"? (hereinafter, referred to as a conventional art 3), a registered Korean Utility Model Laid-Open No. 10-2005-00357610 (published on Apr. 19, 2005) entitled "Position verification system and method of mobile communication terminal using voice information of automatic response system"? (hereinafter, referred to as a conventional art 4-1), and a registered Korean Utility Model Laid-Open No. 20-2005-0374735 (published on Feb. 3, 2005) entitled "Message processing method Frequency modulator" (hereinafter, referred to as a conventional art 4-2).

The conventional art 1-1 is a study for a conventional radio communication, where, in order to efficiently transmit various multimedia information consisted of video, voice and data in a limited RF frequency band, a study for a coding scheme adapted to the channel state and a digital modulation scheme and for MMIC and RFIC satisfying a low price, a high performance and a miniature of an RF module adapted to a high speed broad band property are in progress but they are not realized.

Matters to be considered in such conventional arts to design an efficient RF transceiver by a cascade HBT-MMIC radio amplification theory having a high gain and a low noise index are as follows. That is, in the case of an RF front-end, it is realistic to use an advantage of a superheterodyne method such as a superiority of selectivity, an ease of a channel selection filter condition and a removal of DC offset in a relatively high frequency over a C-band.

However, it is the most serious problem to use an image removal filter of a high Q value in the superheterodyne method, and a study should be performed, to which an active filter should be applied in design of an RF receiver to overcome that. Particularly, since there occur problems such as an increase of a noise index and a bias in an active device in a designing process to apply the active filter to the RF front-end, a recent trend is to design the amplifier by making a cascade coupling of a microwave active device indicating the high gain property and the low noise property simultaneously.

When the amplifier stage is configured by making a cascade coupling of the active device in the CE-CB form, there is an assumption where a frequency property of the amplification stage become excellent since an effective capacitance due to a miller capacitance appearing in an input stage of the amplifier is reduced. However, there occurs another problem that the cascade amplifier has to find a compromise in a low noise property, a high gain and a stability of the amplifier. There is a limitation in a precision and a tracking region of the position. That is, when there occurs a victim in an enormous sea, it is not easy to make a position verification and a tracking region has a limitation.

For example, in a high fidelity video tape recorder which records video information and audio signals, and then reproduces them when needed, signals are recorded as frequency modulated signals. To do this, a frequency modulation circuit is generally configured as an oscillator consisted of registers and capacitors, and a control terminal is equipped externally in order to control a carrier frequency when modulating frequency. A main reason why the external control equipment to control the carrier frequency is used is that an oscillation circuit consisted of registers and capacitors in configuring the frequency modulation circuit is used. That is, when the carrier frequency does not oscillate correctly, the carrier frequency is controlled by controlling a control terminal such as a variable resistor attached externally to match the carrier frequency.

The theory will be described in more detailed as follows.

First, the VOC detects a phase difference by comparing the reference signal which is a predetermined carrier frequency with an output of the VOC which oscillates freely, and has a phase detector for generating an error voltage corresponding to the phase difference and an oscillator for oscillating the error voltage in the same frequency as the reference frequency after receiving the error voltage in a feedback manner. Further, the frequency modulator performs a frequency modulation of the input signals to be recorded with a frequency modulator having the similar configuration as the VOC.

However, the VOC is configured using an oscillation circuit configured with registers and capacitors, and those are used to oscillation frequency modulators having the same configuration. That is, a scheme to control a carrier frequency of the frequency modulator is adopted using the error voltage obtained by the automatic control loop of the VOC, and the VOC oscillates at the same frequency as the reference signal by the feedback loop. At this time, in order to control the frequency of the oscillator more correctly, the carrier frequency is controlled by performing an external control using the variable resistors, and accordingly a set manufacturing should be performed in the process of manufacturing products, such as skilled persons, a usage of parts, measuring equipment, time to control so that it becomes a cause of increase of prime cost.

Furthermore, there is a defect where a circuit for generating an oscillation signal having a frequency of 3.4 MHz is needed. Further, when the frequency of the phase detector becomes high, an error generation ratio becomes high and a control error caused by the skilled person can not be prohibited.

The conventional art 1-2 relates to apparatus and method for modulating bandwidth compression of frequency? whose usage and object are different from the present invention.

As to the conventional art, although technical ideas described in U.S. Pat. No. 3,893,163 have an advantage that there is provided a technology to record video color information and voice information on a record material which is not sensitive to an amplitude such as an optical disk, there also is a defect that the color signal should be far separated from a luminance signal on the frequency spectrum.

Such conventional arts only use the method in a commercial application, which is described in a paper entitled System Coding Parameters, Mechanics and Electro-Mechanics of the Reflective Videodisc Palyer? by P. W. Bogels and N. V. Philips, which was submitted to autumn conference in Washington for the IEEE $17^{th}$ appliance consumer hold on Jun. 8, 1976.

Such a method by Bogels performs a frequency modulation of a carrier wave signal together with a standard NTSC video color signal, and modulates a zero cross of the frequency modulated signal together with a frequency modulated voice sub-carrier wave in a method such as a duty cycle modulation of U.S. Pat. No. 3,893,163.

However, regardless of using any method, there is a problem that information to be recorded on the disk should be in the band width of the disk.

It is because a conventional disk for recording and reproducing video signals has a property of having an upper cutoff frequency of about 13 MHz in its inner circumference.

A desirable method for an optical disk produced in the modulation method in accordance with the present invention includes providing a video carrier wave signal which is frequency modulated together with a complex video signal, where a carrier wave, frequency of about 8.1 MHzcm1 corresponds to a blanking level, that of about 7.6 MHz corresponding to a synchronization signal, and that of about 9.3 MHz corresponding to a white level.

A voice sub-carrier in which 2 separated frequencies are modulated is located between about 2.3 MHz and 2.8 MHz on a spectrum.

Such a method is described in detailed in the Bogels's paper.

Such a method by Bogels described above is used for a standard method in a high performance player for consumers and industry and an optical disk.

There is a radio frequency identification tag (hereinafter, referred to as "RFID tag" of electronic inductance type and electronic coupling type in a conventional art 2-1, and both sides use electronic waves and perform a communication without contacting with a read write terminal and the like.

When the RFID tag described in the conventional art having an antenna coil and a controller receives a transmission signal in the read write terminal using the antenna coil, the controller converts it into power and stores the power in a condenser. Further, the RFID tag transmits information such as ID code stored in the storage to the read write terminal again using the power.

The transmission and reception method includes an Amplitude Shift Keying (ASK) method and a Frequency Shift Keying (FSK) method. The former performs the transmission and reception by the ASK of electromagnetic waves and the latter performs it by the FSK of the electromagnetic waves.

If dividing a general RFID tag into antenna coil types, there exist two types of an antenna coil of a disk type using a circular coreless coil and a cylindrical antenna coil having a ferrite core wound with an electric heating wave anti-node copper wire. Each external shape of them corresponds to a shape of an antenna coil, where the former is formed of a disk shape and the latter is formed of a rod shape.

Here, the RFID tag having the antenna coil of the disk shape performs a communication using a magnetic flux change in the direction of surface of the circular coil, and the RFID tag having an antenna coil on the cylinder performs a communication using a magnetic flux change in the direction of the axis. Here, alternating electric flux and magnetic flux of the electromagnetic wave are converted at a phase of 90 degrees. However, when the magnetic fluxes alternated by the magnetic change are crossed with conductive materials such as iron, aluminum, copper, etc., there occurs overcurrent in the conductive material, and a magnetic flux is generated in the direction which is negative to the alternating magnetic flux by the overcurrent. Accordingly, it is general to locate the conventional RFID tag as far as possible from the conductive material.

As a result, in the case that the RFID tag should be installed adjacent to the conductive material, there is a problem that the overcurrent is controlled by locating the coil surface of the RFID tag and the surface of the conductive material on a plane using the RFID tag having the antenna coil of a disk shape and then making them far from the conductive material by inserting a nun-conductive spacer therebetween, or by transmitting the magnetic flux flowing in the conductive material to a high magnetic permeability material by inserting ferrite core or amorphous magnetic sheet having a high permeability between the coil surface and the conductive material.

Up to recently, it is possible to reduce the effect of the conductive material using such a method, and to perform a communication in the direction perpendicular to the coil surface, that is, in the direction where the magnetic distribution is widen by the antenna coil on the disk.

On the contrary, there is an advantage where the RFID tag having the antenna coil on the cylinder can be made small remarkably compared with the RFID tag having the antenna coil on the disk so that it can be applied to all applications.

However, since it is considered unreasonable in principle to install the RFID tag having the antenna coil on the cylinder on the surface of the conductive material, this was not tried even in the conventional study.

Further, the conventional art 2-1 relates to "RFID tag installation structure, RFID tag installation method and RFID tag communication method"

As such, in the conventional art applying the frequency partially and differently, the frequency used in the ASK wireless communication method may be 50 KHz to 500 KHz in a point of the communication sensitivity (communication length), and 100 KHz to 400 KHz most desirably.

However, the conventional art has no difference from the conventional art 1-2 except that when the RFID tag having the antenna coil on the cylinder formed in the rod shape is installed to be nearly folded with and horizontally to the installation surface of the conductive material, a communication can be performed as a frequency given in the region using a magnetic flux in a space of the installation surface having the RFID tag.

The conventional tag 2-2 relates to a technology connected to the conventional arts 1-2 and 2-1, which is method and apparatus for processing message through RFID?

The conventional art uses a principle where a mutual message transmission and a material transmission can be made only when massage sender and receiver should exist in the same network simultaneously since the messenger service system operates on the basis of a transmission of real time data.

However, since it is not possible to transmit materials or message when a user needs them in such a system, there is a possibility to lose a time to transmit the message, to need an additional infrastructure such as an E-mail, or to restrict the usage.

Furthermore, since it is not possible to verify whether the other party is a true one or not and a user authentication is performed with only simple personal information which is easy to drain out, a confidence to the other party also becomes a problem.

Furthermore, since a home messenger is performed by an unspecified majority in the process of storing and reproducing the message, there is a problem that message transmission among members (for example, family, company) who are formed in a specific district has a limitation of time and place according to a property of the members and task types due to the fact that message recipient cannot be fixed when specified persons exchange messages in a specified group although there is no problem to transmit a simple message among family members, and platforms or products have no mobility or portability due to the fact that the apparatus uses a single equipment several times.

Additionally, the conventional art 2-3 also relates to a technology where an electronic tag system is used in a mobile communication terminal.

The conventional art relates to an electronic tag read system using a mobile communication terminal, and more particularly, to an electronic tag read system using a mobile communication terminal, which includes an electronic tag reader capable of reading RFID tag information in a nun-contacting scheme using a radio frequency identification technology, with which whoever can verify, obtain and utilize electronic tag information attached to each equipment, that is, information of corresponding equipment with ease anytime and wherever using the mobile communication terminal including the electronic tag reader.

Using the conventional art, almost every object such as products, goods, equipment, animal and plant, articles, stocked property has information and price with a bar code attached to it.

However, there are problems such as a high price and an inefficiency to make consumers and producers inconvenient because of various limitation function of the bar code, that is, the bar code should be within a laser region of the read object when reading it, plentiful information cannot be recorded, there is a high possibility of damage, change and forgery, and time and cost are needed to read it.

In order to overcome such problems, a new electronic tag related RFID technology is suggested which can replace it, and the RFID technology utilizing such an electronic tag can be referred to as a wireless identification apparatus which is a field of an automation data collection apparatus with which data is collected or recorded using a wireless frequency to utilize needed information.

A general configuration of the RFID system for the conventional art is as follows.

The RFID system is configured with three factors, that is, transponder which is so called electronic tag, an electronic tag reader, and a host computer or data processing equipment, and the electronic tag has a semiconductor chip (IC chip) manufactured to meet various usage and request and an antenna which can receive a frequency transmitted from the electronic tag reader.

When the electronic tag passes through an effective frequency region of the antenna in the electronic tag reader, it detects signals from the electronic tag reader, and transmits information materials stored in the electronic tag to the electronic tag reader.

The electronic tag reader includes an antenna for transmitting and receiving radio waves, and an electronic circuit for transmitting and receiving the radio waves to and from the electronic tag. The semiconductor chip in the electronic tag reader converts signals incoming from the electronic tag, or stores them in a memory which is a storage while verifying the signals of the data, and may transmit them later when it is needed.

The electronic tag reader which received the data from the electronic tag converts them into digital signals and transmits them to a host computer through a wired or wireless communication network.

However, in the RFID technology using such an electronic tag, the electronic tag has a defect that information of the electronic tag can be recognized only when there is a separate electronic tag reader. Conventionally, individuals, or consumers and users of company do not have the electronic tag reader so that there is almost no way to utilize the information of the electronic tag.

That is, in the case that when there is not the conventional electronic tag or a separate electronic tag reader is used, there is an inconvenience as follows.

First, while the electronic tag includes a storage, different from the bar code so that various information can be stored, such as manufactured date, original production site, product guarantee, product authentication, distribution process, effective period, history matter, general consumers or users may experience forged or changed products purchase, unconfirmed effective period, and obscurity of original production site since they cannot confirm such information.

Second, it is not easy to obtain information contained in the electronic tag of various installations, that is, tour information, traffic information, position information, etc.

Third, users cannot read and utilize the electronic tag in a ubiquitous computing age to be popularized from no on so that it brings about vast inconveniences.

Fourth, when a user wishes to perform a management task efficiently using the electronic tag which is used for property, equipment, products, physical distribution, stock, animals, etc., he or she has to purchase a separate electronic tag reader so that additional costs are generated, and there occur inconveniences to hold separate readers.

The conventional art 3 relates to "Flip type terminal having microstrip fetch antenna for GPS" which is a study related with GPS antenna attached to the GPS terminal to add the conventional GPS service function.

Conventionally, GPS service function refers to an added service to receive GPS satellite information and hold individual position information so that it is widely used to E911 service for holding an individual security, navigation system, physical distribution, leisure, etc. For such a GPS service function, an antenna for the GPS is mounted on a generalized handheld terminal. Conventionally, it was general that the GPS antenna is mounted on the main body in a projecting manner.

Main types of such a GPS antenna are a ceramic fetch antenna where a ceramic patch of ceramic shape is cased with a plastic injection molding, and a helix antenna where cylindrical Teflon type is cased with a plastic injection molding formed of twisted power supplying wires.

However, since such a conventional antenna should be large in size of the main body considering the mounting space, it is not possible to mount it inside the main body, and it is not easy to match an angle to the satellite to receive the GPS satellite signals due to the interference with other parts even though it is mounted in the main body.

Accordingly, the conventional GPS antenna should be mounted outside the main body. However, since the size of the main body should be large in the case that the antenna is applied to the terminal and GPS terminal which are minimizing and sliming more and more, the user experiences inconveniences to hold it and there is a limitation to variously design it.

In reality, in the case of the ceramic patch antenna among the conventional GPS antenna, the patch size is 25 mm×25 mm×4 mm, and in the case of cylindrical helix antenna, it is 50 mm×15 mm. So, it is not possible to mount the antenna in the miniaturized terminal main body. Further, the conventional GPS antenna becomes a large obstruction to miniaturization and sliming of the main body even though it is mounted outside the main body.

Additionally, in the case of carelessly dropping the handheld terminal on the ground, there occasionally occurs the case that the antenna of the main body, especially, the GPS antenna is damaged, so that the terminal cannot provide the GPS service.

The conventional art 4-1 relates to "Position verification system and method of mobile communication terminal using voice information of automatic response system"

The conventional art relates to a position verification system and position verification method capable of providing position information of the specific mobile communication terminal verified through the position search using an automatic response system. The position verification system of the mobile communication terminal in accordance with one embodiment includes a side module for identifying a base station on a radio access network connected to a second terminal unit or a core network in the case that a page request to the LBS platform module for generating a page request of the second terminal system is generated, and an information provision control module for controlling the automatic response system so that the generated position information is informed to the first terminal unit as voice data. Such an object is converted, more specifically, applied to the position verification system and position verification method capable of providing the position information of a specific mobile communication terminal verified through the position search.

Such a position search service is embodied in a method for predicting the position of the other party by identifying the cell position of near base station which verified an access of the mobile communication terminal of a specific user.

However, such a conventional position search service provides information on the position of the mobile communication terminal whose position is verified with visual information such as text or map (image), so that there is a severe restriction to a user whose terminal cannot display such visual information to provide the position search service.

Further, since all manipulations to make the position search service is used by an interface depending on key buttons of the user's terminal, it becomes a barrier to block access to the service to users who are not familiar with it. Further, it is fact that the interface depending on the key buttons requests a very troublesome key button manipulation, such as a wireless (or wired) Internet access, a position search service menu access, a position search object input, etc. to receive the position search service so that it obstructs an activation of the service usage.

Accordingly, it is deeply requested to provide a position verification system and method of a mobile communication terminal having a new concept, which can provide the service of the interface for the position search with a simple key manipulation so as to enhance a service access, and can provide information on the verified user's position with a voice which is easy to obtain information.

The conventional art 4-2 can be divided into "Wireless emergency call system" and the like.

The conventional art relates to an emergency call system in a particular place (for example, an underground parking lot, a crime ridden area), and more specifically, to a wireless emergency call system capable of informing a central control center (for example, an apartment superintendent, a police station, a fire station) of an emergency situation when a crime or a fire breaks out in a specific area. The object of the conventional art is to configure an emergency call system capable of collecting an emergency call wireless signal for the emergency situation from the handheld call terminal and transmitting it to a control center. Therefore, when a crime or a fire breaks out in a specific area, such emergency situation is informed to a central control center (for example, a control office, a police station, a fire station) which is located in the other location so that a rapid response is made for such situations, and a convenience of usage is enhanced by improving an inconvenience based on the control of the conventional emergency bell and adding RFID output material for opening and closing of the entrance door of the parking lot as well as various kinds of entrance doors to a call terminal of the wireless emergency call system.

When integrating the conventional arts described above, it can be understood that the radio wave interference system in the theory for the interspace-VLBI defined in the present invention can be divided into several types according to methods of synthesizing radio wave signals emitting from each antenna.

In an embodiment, a method for enhancing a precision of the measuring network includes a method for enhancing a precision of an orbit element of a satellite by observing the GPS from many observatories. However, there is an error in the satellite orbit element, and it makes an effect so much in the precision of the GPS.

First, the radio wave can be synthesized by making a connection using a direct cable, and this case is referred to as radio wave array. The radio wave array is very useful for a short distance interference system in installation and management, so that it is installed and used often in an actual astronomical study in countries such as United States, Japan, European countries.

In the case of a radio wave interference system where a mutual distance is hundreds or thousands of Km in order to obtain a space definition higher than the radio wave array, since it is not possible to connect it directly through the cable, signals emitted from each antenna are recorded on each tape and the tapes are gathered again and synthesized. That is, the GPS is observed from the VLBI view point in a method considered to enhance the precision of the orbit element.

In other words, after the precise relative position is determined using the VLBI observation network, the GPS also enhance the precision of the orbit determination when calculating the position of the satellite for the VLBI searching point by searching the satellite, wherein the precision of 2-3 cm is obtained for the distance over hundreds of km using the GPS-VLBI method. This case is referred to as VLBI.

Second, the theory for the HDX radio wave propagation extension modulation of the RFID means that when information processed after receiving signals from the GPS satellite and a pseudo satellite is transmitted to the central control center through a mark signal of the wireless tag attached to the GPS terminal for the life jacket, correction information is calculated there, and various processing is performed so that correct positions of victims are listed one by one.

Such a function is similar to the function applied to a general GPS satellite signal in the sea control system currently, where a correct position can be calculated by applying D-GPS for correcting code information and CD-GPS method for determining carrier wave information.

In a function endowed as described above, when each indication mark of the wireless tag (RFID) attached to the GPS terminal for life jacket is endowed with a unique number and transmitted, it is possible to recognize positions of hundreds of victims at a time. Further, since it is possible to correctly mark information on sea area, position of victim, distance, etc. on a disaster of sea guidance map so that there are increased interests in sea information and a disaster rescue.

Third, according to the theory of a frequency radio wave amplification transmission method of a microstrip patch antenna, a method for changing a frequency radio wave amplification where the patch is changed in three dimensional structure by attaching an Iris to the microstrip patch antenna attached to the GPS of life jacket is adopted.

Fourth, an emergency rescue 110 frequency emitted from the GPS terminal of life jacket can be serviced in multiple voice information through the location based service which is a core technology formed in a complex function.

In the conventional art described above in accordance with the present invention, it can be found that frequency band (130 dBm) signal intensities related to the frequency requested in each item of first, second, third and fourth items have a common factor.

Reviewing an interspace-VLBI in the first item, the common factor is that it is possible to obtain a radio wave propagation extension and modulation and frequency propagation amplification using the interspace-VLBI and coupling method as a frequency band (130 dBm) signal having almost same signal intensity from all satellites in the GPS satellite signal system among the satellites.

In the second item, the communication region needed to the HDX radio wave propagation extension and modulation of the tag (RFID) has a property where it is propagated far as the frequency of the signal becomes low, and there is a problem that the radio wave of the signal experiences a diffraction phenomenon in the material having the size of the wavelength of it. As a result, when the wavelength becomes short, it is severely affected by the environment so that it becomes almost non-practical over 2 GHz. Accordingly, it becomes possible to make a radio wave propagation extension and modulation and frequency propagation amplification using the interspace-VLBI and coupling method by the minute radio wave signal system of 130 dBm with an active tag frequency.

In the third item, the frequency amplification transmission method of the microstrip patch antenna is needed in an utilization of the minute radio wave signal intensity of about 130 dBm for the radio wave propagation extension and modulation and frequency propagation amplification using the change method of the frequency propagation amplification where the patch is changed in the three dimensional structure by attaching the Iris to the microstrip patch antenna attach? to the GPS terminal for life jacket in the actual GPS satellite signal system among satellites described above.

In the fourth item, the LBS means all fields which provide requested services based on the position of the client (handheld phone or PDA), it means an integrated service to provide moving persons with correct position information with ease and high speed from the existing network and wireless communication network. The located based service technology which is a next generation GIS core technology is a technology with which a location based service is utilized with his or her native language using his or her terminal in any place in the world, wherein in the case that it is commercialized in multiple languages using the minute radio wave signal of 130 dBm in a single database, the frequency of the emergency rescue signal transmitted from the GPS terminal of the life jacket can be changed into a multiple language voice information service through the location based service that is a GIS core technology formed in the complex function.

DISCLOSURE

Technical Problem

It is, therefore, an objective of the present invention to embody a frequency extension system by a radio wave extension and modulation and a radio wave amplification transmission utilizing a minute propagation signal system of about frequency band 130 dBm. In other words, it is an objective of the present invention to provide a frequency propagation amplification method of a microstrip patch antenna having HDX radio wave propagation extension and modulation of the RFID and an Iris using the interspace-VLBI and a coupling method in the frequency band 130 dBm of the GPS frequency of the life jacket, and a frequency complex multiple function system capable of serving the multiple voice information service connected to the location based service which is a GPS core technology in which frequency of the emergency rescue signal transmitted from the GPS terminal of life jacket.

Another object of the present invention is to transmit a minute radio wave that is an emergency rescue signal in the sea transmitted from a victim having the GPS terminal of life jacket to the GPS satellite in the space utilizing the same frequency as the existing surface elastic wave which is formed in the earth atmospheric zone. That is, the object is to embody an extension wavelength phase change of the output stage through a central frequency movement according to a gas absorption of the earth atmospheric zone using frequency band (130 dBm) signal having almost same signal intensity from all satellites in order to obtain the radio wave propagation extension and modulation and frequency propagation amplification. It means the process of forming the radio wave propagation extension and modulation and frequency propagation amplification through the same frequency band 130 dBm as the existing surface elastic wave formed in the frequency 130 dBm propagation signal transmitted from the interspace-VLBI.

A study for extension and movement of the output for the frequency through sensors for sensing whether an analysis gas of the atmospheric layer of the earth atmospheric zone is absorbed or not has been performed, and various gas sensors to measure it for the frequency movement path of current atmospheric layer become practical. However, there is not a method for coupling the frequency band (130 dBm) to the intersapce-VLBI using the frequency band (130 dBm) having almost same signal intensity from all satellites in order to obtain the radio wave extension and modulation and frequency propagation amplification in the actual GPS satellite signal system among satellites, and the same signal intensity as the existing surface elastic wave formed in the earth atmospheric zone. One of the reasons is that since an operation principle of a general surface acoustic wave gas sensor is that a surface acoustic wave is obstructed in its progress due to the minute mass change appearing after the gas is absorbed in a piezoelectric device, and then the detection equipment of the gas sensor converts a chemical change occurring by the absorption of detection target gas on the surface of the device into an electric signal, while sensing performance for a specific gas sensing quality is excellent, there is a problem in a measurement to embody the frequency change circuit.

Using the frequency band (130 dBm) formed in the conventional surface acoustic wave gas layer of the atmospheric zone to be obtained from the present invention, there is provided a forming process of the radio wave propagation extension and modulation and frequency propagation amplification by synthesizing the wavelength movement path of the output stage according to a gas absorption of the earth atmospheric zone and the 130 dBm radio wave signal transmitted from the interspace-VLBI.

By adding the complex multiple function in the process, there is provided first, that since the suggested method has a property in which a communication region needed to make the HDX radio propagation extension and modulation of the tag (RFID) becomes far as the frequency of the signal becomes low, it can be applied when the interspace-VLBI and coupling method are secured using the frequency band (130 dBm) signal having nearly same signal intensity from all satellites in order to obtain the radio propagation extension and modulation and frequency propagation amplification in the real GPS satellite signal system between satellites, second, by forming the head unit for supporting the frequency propagation amplification transmission of the microstrip fetch antenna by attaching the Iris to the body, the practical GPS satellite signal system can be applied between the satellites when the interspace-VLBI and coupling method are secured using the frequency band (130 dBm) signal having nearly same signal intensity from all satellites in order to obtain the radio propagation extension and modulation and frequency propagation amplification, there is an effect that a method for changing the frequency propagation amplification can be embodied where the fetch itself is changed in a three dimension configuration by attaching the Iris to the microstrip fetch antenna, third, in each item, it is possible to embody a multiple language voice information service through the location based service which is a GIS core technology where a frequency of the emergency rescue signal transmitted from the GPS terminal of the life jacket is formed as a complex function.

As described above, in the case that a victim having the GPS terminal of the life jacket outputs a minute radio wave which is an emergency rescue signal in the sea, the transmitted frequency shares the same frequency band (130 dBm) as the existing surface acoustic wave formed in the earth atmospheric zone, so that using the measuring equipment mounted on the measuring station such as the GPS satellite in the space, a pseudo satellite, etc., needed information is extracted after measuring/recording victim in the sea through media such as electromagnetic energy which is reflected and radiated in various wavelengths.

Technical Solution

According to an aspect of the present, there is provided a complex multifunction system of a frequency band (130 dBm) frequency extension modulation of a GPS terminal in a life jacket, comprising, a body including a front plate which transmits and receives a frequency transferred from the GPS terminal in a life jacket in a process of introducing and sharing a coupling scheme with interspace-VLBI in frequency band 130 dBm, and a rear plate which is in contact with a tag of an HDX frequency extension modulation; a head unit for attaching a iris on a head of the body and supporting a frequency propagation amplification transmission of a microstrip patch antenna; and a location based service attached to a middle portion of the front plate of the body or a head unit, having a function of transmitting an emergency rescue signal and converting the signal into a multi-language voice information service, wherein a modulation of radio wave propagation and a frequency propagation amplification are performed in the body and the head unit.

Preferably, the body is comprised of the front plate which transmits and receives a frequency transferred from the GPS terminal in a life jacket in a process of introducing and sharing a coupling scheme with interspace-VLBI in frequency band 130 dBm, and the rear plate which is in contact with a tag of an HDX frequency extension modulation; the head has an iris attached on the head of the body and supports a frequency propagation amplification transmission of the microstrip patch antenna.

Preferably, a frequency modulator in which a modulation is performed in a radio wave amplification transmission method remotely used in a frequency of frequency band 130 dBm requested in the GPS terminal in the life jacket and has an oscillator having the same configuration as the VCO, has a frequency shift keying/carrier frequency revision control circuit comprised of an automatic frequency detection circuit for phase comparing with a fixed frequency signal whose frequency is lower than a carrier frequency and an output of the voltage controlled oscillator (VCO) which oscillates in a frequency which is multiple times of the frequency with a signal divided in multiple times, a VCO whose input is an error voltage of the output of the frequency detection circuit, an error current generator having a voltage/power converter for converting an output error power of the PLL (Phase Locked Loop) including a frequency divider for dividing a high frequency of the VCO, a feedback clamping (FBC) circuit for receiving the low fixed frequency signal, an input signal to be converted in frequency and a reference voltage determining a clamping level and then clamping the input signal, and an adder for adding an error current and a deviation current, where the frequency of the input signal is modulated in a set carrier frequency.

Preferably, a chip material of the GPS terminal in the life jacket is so adapted that a victim can wear an active tag (RFID, Radio Frequency Identification) on the rear plate in the HDX radio wave propagation scheme using the frequency band 130 dBm.

Preferably, an iris is attached to the micro-strip patch antenna inserted into the GPS terminal in the life jacket, and the frequency where the patch is converted into a three dimension configuration is processed in a radio wave amplification scheme using the frequency band 130 dBm remotely.

Preferably, the frequency of the emergency rescue signal transmitted from the GPS terminal in the life jacket is converted in a multilanguage voice information service scheme using the location based service which is a GIS core technology formed in a complex function.

Advantageous Effects

The GPS terminal for life jacket in accordance with the present invention is configured as the frequency extension and modulation complex multifunction system in a frequency band (130 dBm), and its main originality and a difference from an existing method are as follows.

The frequency extension and modulation complex multifunction system in the frequency band (130 dBm) of the GPS terminal of the life jacket in accordance with the present invention forms the front plate which transmits and receives the frequency transmitted in the GPS terminal of the life jacket in the process of inducing and sharing the interspace-VLSI and coupling method in the frequency band (130 dBm) and the bottom plate which is contacted with the tag of the HDX frequency extension and modulation. So, since the suggested method can be applied when the interspace-VLBI and coupling method are secured using the frequency band (130 dBm) signal having nearly same signal intensity from all satellites in order to obtain the radio wave extension modulation and frequency micro wave amplification in a real GPS satellite signal system between satellites, there is no limitation in the noise space vector dimension and the size of the covariance matrix is reduced so that the calculation complexity is reduced and the embodiment can be easy.

Further, the frequency of the antenna which is applied to the RFID system generally uses various frequency bands from a low frequency band of 125 kHz to a micro wave band of 5.8 GHz. However, the micro wave has a severe diffraction phenomenon in a material having the same size as a wavelength in a complex earth atmosphere environment such as a multiple path error, a satellite orbit error and clock error, a convective zone error, an ionospheric zone error, etc. Resultantly, when the wavelength becomes short, it is affected in a large scale by the environment so that it is rarely practical in frequencies above 2 GHz.

Accordingly, there is an effect that a cause of the same signal intensity frequency is embodied from the channel estimation algorithm which has a reduced complexity in the DS/CDMA DMA downward link (point to multipoint) by coupling a partial space channel algorithm with a match filter. For example, in the case of the point and multipoint system such as a digital multimedia broadcast (DMB), a practical assumption can be generally made as follows. First, the downward link signal is synchronized in a transmission stage and has the same signal power. Second, the downward link signal passes the same radio propagation channel.

The point-to-multipoint mobile receiver adopted in the frequency extension and modulation complex multifunction system in the frequency band (130 dBm) of the GPS terminal of the life jacket in accordance with the present invention knows diffusion code of all channels.

Since the suggested method has a property in which a communication region needed to make the HDX radio propagation extension and modulation of the tag (RFID) becomes far as the frequency of the signal becomes low, it can be applied when the interspace-VLBI and coupling method are secured using the frequency band (130 dBm) signal having nearly same signal intensity from all satellites in order to obtain the radio propagation extension and modulation and frequency propagation amplification in the real GPS satellite signal system between satellites.

Additionally, by forming the head unit for supporting the frequency propagation amplification transmission of the microstrip patch antenna by attaching the Iris to the body, the practical GPS satellite signal system can be applied between the satellites when the interspace-VLBI and coupling method are secured using the frequency band (130 dBm) signal having nearly same signal intensity from all satellites in order to obtain the radio propagation extension and modulation and frequency propagation amplification, there is an effect that a method for changing the frequency propagation amplification can be embodied where the patch itself is changed in a three dimension configuration by attaching the Iris to the microstrip patch antenna.

Resultantly, a limitation of a coding method and a digital modulation method suitable to the channel state in order to effectively make a transmission in the RF frequency band limited by the cascade HBT-MMIC propagation amplification theory having a high gain and a low noise index can be overcome. Further, while a merchandise development of a module by the MMIC and RFIC meeting a low price, a high performance and a miniaturization of the RF module adapted to a high speed broad band property is not realized but under investigation, it will be substituted with the present invention.

The present invention includes a location based service having a transmission function of the emergency rescue signal capable of forming the radio propagation extension modulation and frequency propagation amplification by being attached to a middle portion of the body front plate or the head unit, and capable of converting, this into a multiple language voice information service, so that it is possible to embody a multiple language voice information service.

While the GPS terminal having the interspace-VLSI and the coupling method function capable of frequency transmission and reception output cross for the frequency band (130 dBm) having nearly same signal intensity from all satellites in order to obtain the radio propagatin extension modulation and the frequency propagation amplification in the real GPS satellite signal system between satellites having specific shape and configuration is described with reference to the accompanying drawings, it will be understood by those skilled in the art that various changes in form and details may be made therein without departing from the spirit and scope of the present invention.

EXPLANATION FOR REFERENCE SYMBOLS

Figure 1:
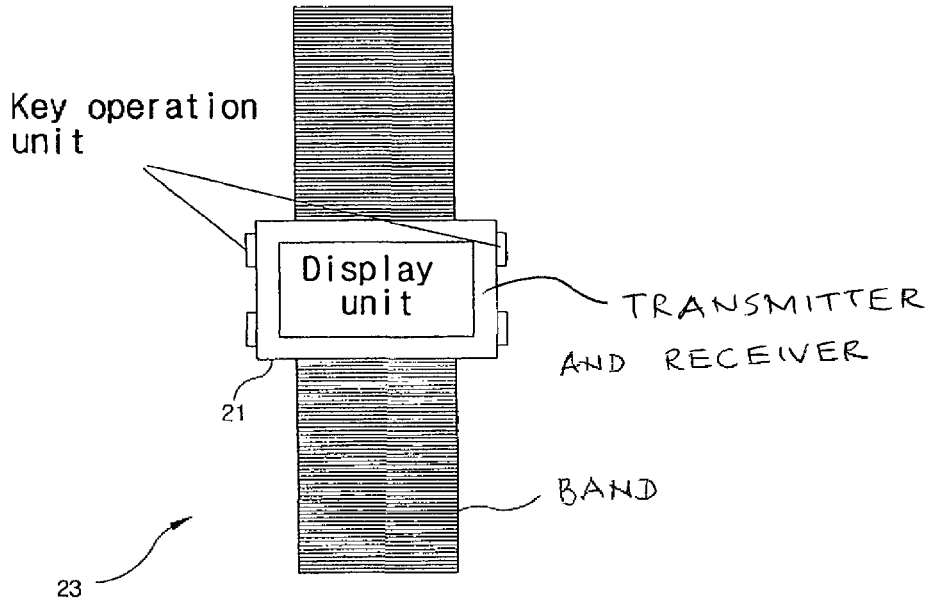
FIG. 1 is a front view in accordance with an embodiment of the present invention.

10: head unit
21: front pleat front plate
20: body
22: bottom plate
23: microcomputer 30: location tracking terminal
31: interspace-VLBI receiver
32: controller in a location based service
40: rescue signal (119 frequency) receiver
50: electronic tag (RFID) 51: electronic tag reader
60: Iris unit 61: microchip patch antenna
62: frequency band (130 dBm)

BEST MODE

A GPS terminal in a life jacket in accordance with the present invention is preferably comprised of a body including a front plate which transmits and receives a frequency transferred from the GPS terminal in a life jacket in a process of introducing and sharing a coupling scheme with interspace-VLBI in frequency band 130 dBm, and a rear plate which is in contact with a tag of an HDX frequency extension modulation, a head unit for attaching an iris on a head of the body and supporting a frequency propagation amplification transmission of a microstrip patch antenna and a location based service attached to a middle portion of the front plate of the body or a head unit, having a function of transmitting an emergency rescue signal and converting the signal into a multi-language voice information service, wherein a modulation of radio wave propagation and a frequency propagation amplification are performed in the body and the head unit.

MODE FOR INVENTION

The present invention will now be described more fully hereinafter with reference to the accompanying drawings.

Figure 2:
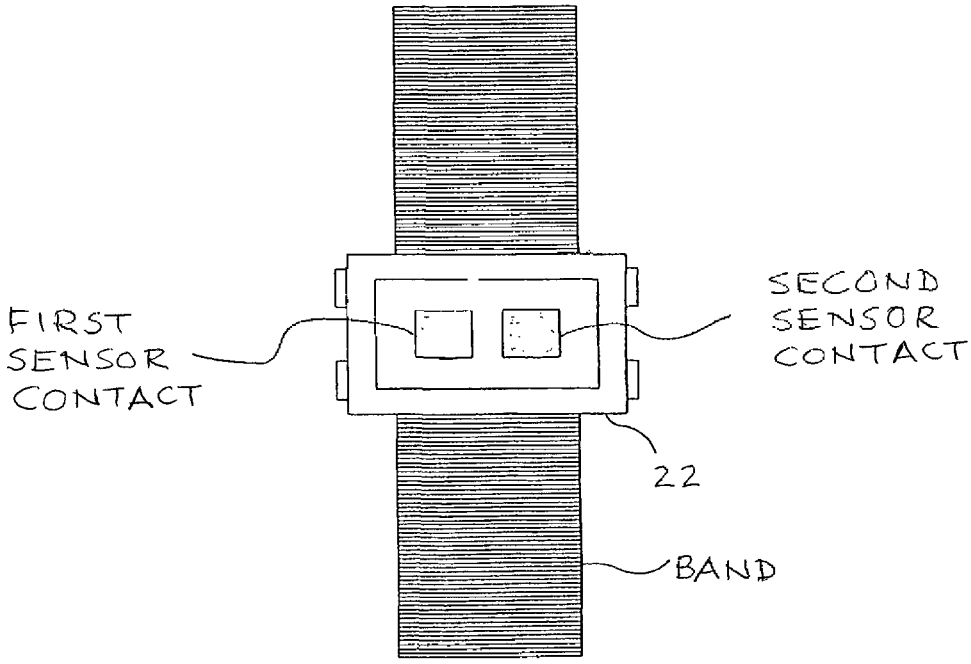
FIG. 2 is a bottom view in accordance with an embodiment of the present invention.
Figure 3:
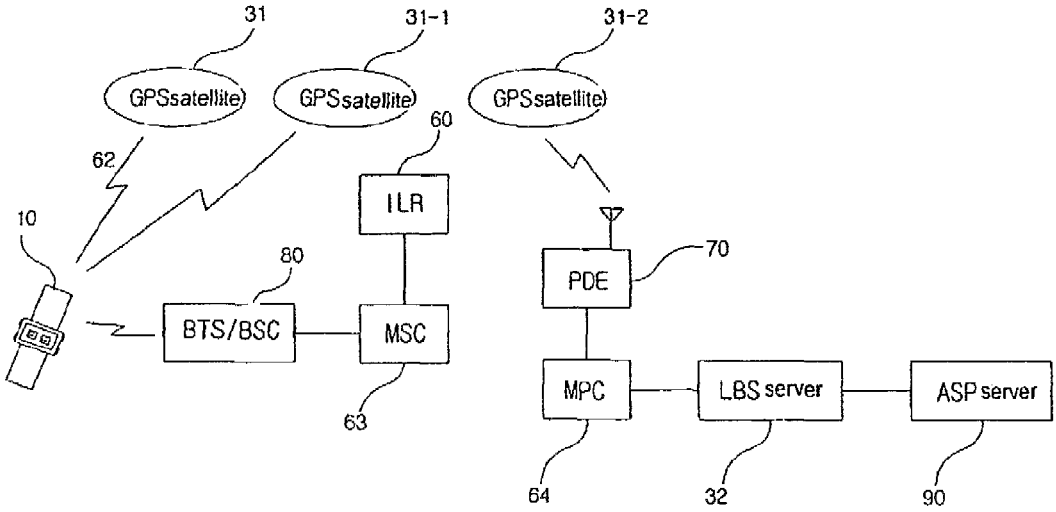
FIG. 3 is a view showing a configuration of a location measurement system of a GPS terminal to which the present invention is applied.

FIG. 1 is a front view in accordance with an embodiment of the present invention, FIG. 2 is a bottom view in accordance with an embodiment of the present invention, and FIG. 3 is a view showing a configuration of a location measurement system of a GPS terminal to which the present invention is applied.

Referring to FIGS. 1 to 3, it can be understood that a complex multifunction system of a frequency band (130 dBm) extension modulation of a GPS terminal in a life jacket in accordance with the present invention includes a video function connected with a navigator.

The present invention will now be described more fully hereinafter with reference to the accompanying drawings, in which preferred embodiments of the invention are shown so that this disclosure will be thorough and complete, and will fully convey the scope of the invention to those skilled in the art.

As shown in FIG. 1, a microcomputer 23 exposed on a front plate 21 is a thin plate having a thickness of 8 mm and a size of a width (25 mm)×a length (55 mm), which is generally divided into a first sensor contact and a second sensor contact, both of them are mounted therein in a form of chip devices. It includes two pairs of switches which are located in upper and lower parts, each pair having two protruded switches on a key operation unit of a display unit in left and right sides of a straight line so that the switches can be operated (on and off) by a manual operation to indicate an emergency situation when meeting with a disaster.

Here, a pair of switches on the upper part is made of an On operation line and a pair of switches on the lower part is made of an Off operation line. Especially, in On or Off operation state, the left side is a main switch and the right side is an auxiliary switches. An auxiliary switch is equipped with the provision that the main switch does not smoothly operate in an emergency situation when meeting with a disaster.

In the complex multifunction system of a frequency band (130 dBm) extension modulation of the microcomputer 23, the front plate 21 that transmits and receives the frequency transmitted from the microcomputer 23 through the wavelength of the output stage in the process of introducing and sharing the interspace-VLBI and coupling scheme in the frequency band (130 dBm) is shown in front view which is generally divided into a band and a display unit. Its constituents are described in detail as follows.

In the emergency rescue signal (119 frequency) in accordance with the present invention, the microcomputer 23 system is formed in an automatic On operation by inserting a portion protruded on the left side in the key manipulation unit attached on the microcomputer 23. For the rescue request with respect to the emergency situation of the victim, the emergency rescue signal (119 frequency) is repeatedly transmitted in an interval of 3 to 4 seconds.

Next, as shown in FIG. 2, the bottom plate 22 is generally contacting a band and a first sensor contact and a second sensor contact both built in the display unit. It modulates a covariance matrix size of a signal space in a microwave amplification transmission scheme which has an orthogonality in embodying a partial space channel estimation by using a location tracking terminal (30, apparatus or chip device) configured in the first sensor contact as the frequency band (130 dBm) 62 which is the frequency by the microcomputer 23 remotely. Also, the frequency modulator having the same oscillator as the VCO is comprised of an automatic frequency detection circuit for phase comparing and a fixed frequency signal whose frequency is lower than a carrier frequency and an output of the voltage controlled oscillator (VCO) which oscillates in a frequency which is multiple times of the frequency with a signal divided in multiple times, VCO whose input is an error voltage of the output of the frequency detection circuit, an error current generator having a voltage/power converter for converting an output error power of the PLL including a frequency divider for dividing a high frequency of the VCO, a feedback clamping (FBC) circuit for receiving the low fixed frequency signal, an input signal to be converted in frequency and a reference voltage determining a clamping level and then clamping the input signal, and an adder for adding an error current and a deviation current, where the frequency of the input signal is modulated in a set carrier frequency.

The constituents of it will be described in detailed as follows.

The system includes a body having a bottom plate 22 forming a tag (RFID) of an HDX frequency extension modulation portion using the location tracking terminal (30, apparatus or chip device) vector; a head unit for attaching an iris on a head of the body and supporting a frequency propagation amplification transmission of a microstrip patch antenna; and a location based service attached to a middle portion of the front plate of the body or a head unit, having a function of transmitting an emergency rescue signal and converting the signal into a multi-language voice information service, wherein the location based service (32, LBS server) is comprised of a first sensor contact and a second sensor contact installed in the display unit of the microcomputer 23.

The emergency rescue signal (119 frequency) of the present invention is modulated in frequency by a frequency modulator (d_1) by way of a carrier frequency correction controller (a_2) installed in the first sensor contact mounted in the microcomputer 23 and outputted. Here, the oscillator in the frequency modulator has the same configuration as the VCO of the error current generator (a_1) so that the error voltage (Verr) is applied to the frequency modulator (d_1) as well as the VCO and then it is possible to obtain the carrier frequency controlled automatically without an external control. The frequency correction controller (a_2) includes the error current generator (a_1) and the deviation current generator (a_3), outputs (Ierr and Idev) of the circuit blocks (a_1 and a_4) are added in the adder (a_5) and output as a correction signal (a_2).

The error current generator (a_1) generates an error current Ierr by the voltage/current converter (a_9) by way of a Phase Lock Loop (PLL) block consisted of an automatic frequency detector (a_6), a frequency divider (a_7) and an oscillator (a_8).

Here, the deviation current generator (a_3) generates the deviation current Idev by way of a feed back clamping circuit (a_10) receiving a synchronization signal fh and a video signal, a band gap reference signal (a_11), and a mutual conductance amplifiers (c_1, c_2) as a voltage/current converter.

Specifically, the VOC of the present invention is characterized in that it compares a reference signal of a desired carrier frequency with an output of the VOC which vibrates freely and detects a phase difference and has a phase detector for generating an error voltage corresponding to the phase difference and an oscillator for receiving the error voltage in feedback and oscillating it as the same frequency as the reference frequency.

Accordingly, the frequency modulator has a configuration similar to the VCO to modulate the input signal to be recorded.

Since the oscillator is configured as the mutual conductance amplifiers (c_1, c_2) having the characteristics described above, the VOC (b_3) of the 320 fH is the same as an oscillation frequency variance configured in the frequency modulator (d_1) shown in FIG. 5 to be described below even though the oscillation frequency changes due to any reason.

The error current generator (a_1) is basically comprised of a PLL, and the oscillation frequency of the VOC (b_3) has 5.04 MHz, for example. The signal has a fH frequency signal which is applied to the automatic frequency detection circuit (b_1) through 1/320 fH frequency divider so that it is compared with a fH synchronization signal applied externally and generates an error voltage Verr corresponding to a mismatch phase difference. The error voltage Verr is applied to the VOC(b_1) again and correctly oscillates at 5.04 MHz. The error voltage Verr is inputted to the VOC(b_1) of the 320 fH and the voltage/current converter (b_4), and then connected to the frequency modulator (d_1). The error voltage Verr is converted into the corresponding amount of current and outputted by the voltage/current converter (b_4) so that the error current Ierr is generated.

FIG. 3 is a view showing a configuration of a location measurement system of a GPS terminal to which the present invention is applied.

Referring to FIG. 3, the system is comprised of a head unit 10, a microcomputer 23, a location tracking terminal 30, an interspace-VLBI receiver 31, a controller in a location based service 32, an emergency rescue signal (119 frequency) transmitter 40, an electronic tag (RFID) 50, an electronic tag reader 51, an Iris unit 60, a microstrip patch antenna 61, a frequency band (130 dBm) 62. A detailed description of the constituents will be given as follows.

The emergency rescue signal (119 frequency) transmitter (BTC/BSC) 40 that includes the GPS transceiver related to a signal system of a victim emergency situation in accordance with the present invention and location information from the GPS pseudo satellites 31 and 31-1 transmits to a position determination entity (PDE) 70 base station information including the location information, local information between the base station and the microcomputer 23, and base station information including sea, ship or airplane phase information through the switch MSC 63. The PDE 70 calculates the location on the basis of the location information received from the microcomputer 23. The PDE 70 can also include the GPS receiver and then the location information from the GPS satellite 31-2, and utilizes it to calculate the position of the microcomputer 23. Further, the PDE 70 receives mobile video and position information of the microcomputer 23 managed in the victim position registration conversion apparatus (Iris unit, ILR) 60 as well as position information and base station information calculated in the longitude and longitude information received from the microcomputer 23, and makes the position of the microcomputer 23 more correct The mobile positioning center (MPC) 51 provides mobile video and positioning information based on a multiple language voice information service conversion in which the frequency band (130 dBm) 62 frequency transmitted from the microcomputer 23 forms the micro wave propagation extension modulation and frequency propagation amplification according to an emergency rescue signal request from a victim of the location based service (LBS server) 32 where a personalization and a mobility are coupled among the information communication and the wireless Internet service. Further, it receives entire information in the microcomputer 23 and transmits them to the LBS server 32. When the mobile video and positioning information is transmitted to the LBS server 32 through the electronic tag reader MPC 64 which is a monitoring recognition system after exchanging it with a general mobile computer peripheral, the LBS server 32 transmits the information to an application service provider service ASP 40 and utilizes it to provide various mobile video and positioning based service provider with a basic material.

Figure 4:
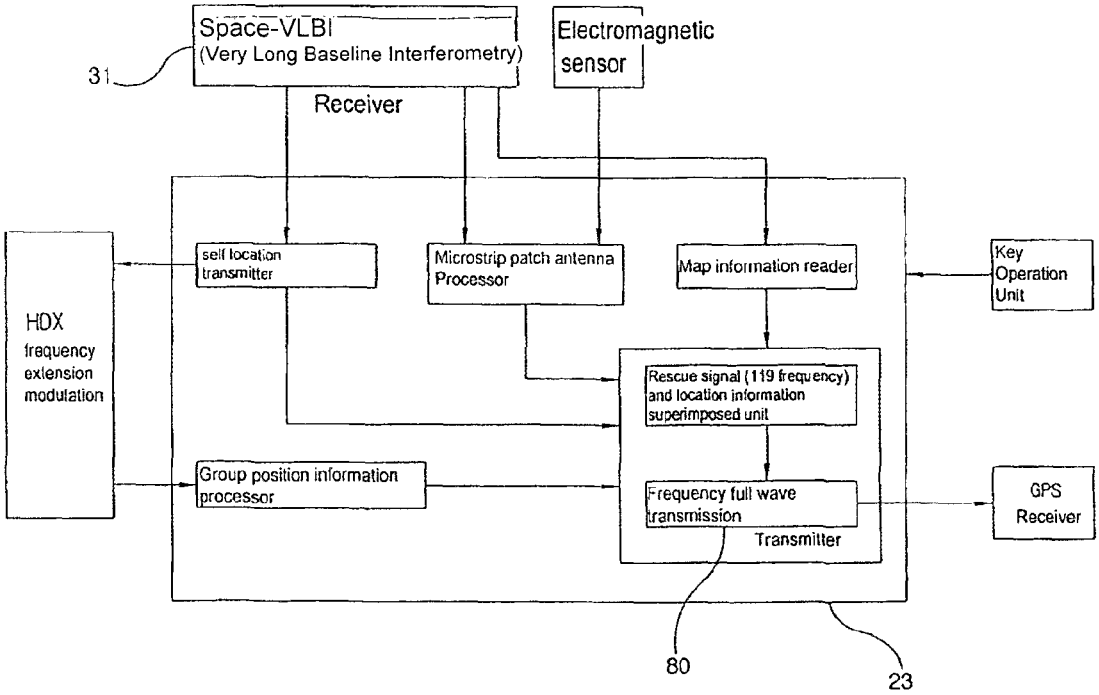
FIG. 4 shows a schematic block diagram of a position tracking terminal in accordance with an embodiment of the present invention.
Figure 5:
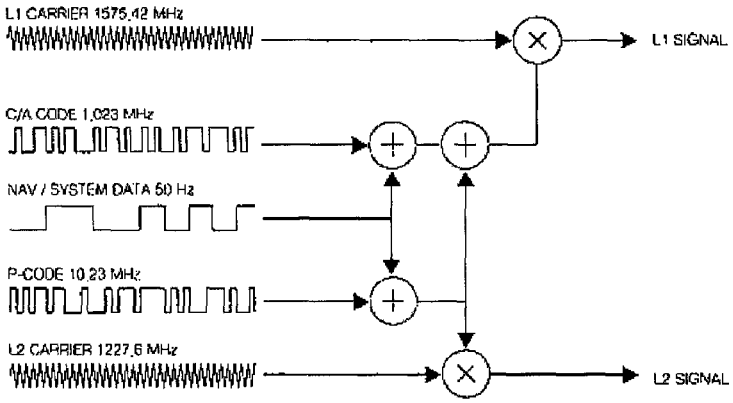
FIG. 5 is a view explaining a procedure for modulating a frequency band 130 dBm of a signal intensity in accordance with an embodiment of the present invention.

FIGS. 4 to 8 show a schematic block diagram of a position tracking terminal and is a view explaining a procedure for modulating a frequency band 130 dBm of a signal intensity in accordance with an embodiment of the present invention. A frequency modulation circuit including a correction circuit which automatically and regularly controls a carrier frequency of the frequency modulation circuit to record a frequency signal on a magnetization record media, is shown in FIG. 5 as a block diagram.

Figure 9:
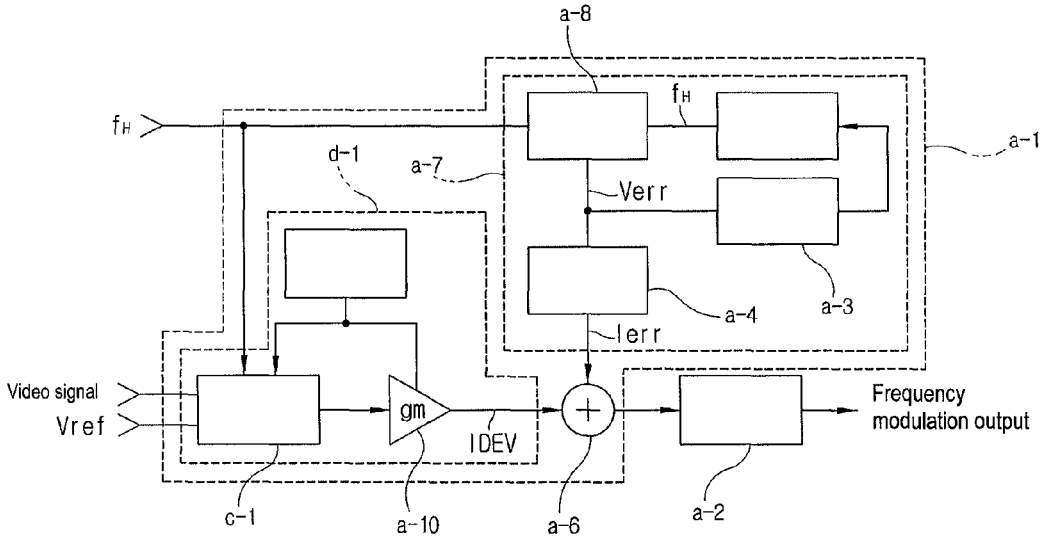
FIG. 9 is a detailed block diagram showing a configuration of a frequency modulator shown in FIG. 4.

FIG. 9 is a detailed block diagram showing a configuration of a frequency modulator shown in FIG. 4.

In accordance with the present invention, a frequency signal is modulated and output by a frequency modulator (d_1) by way of a carrier frequency correction controller (a_2). An oscillator included in the frequency modulator particularly has the same configuration as a VOC of an error current generator (a_1) so that an error voltage Verr is applied to the frequency modulator (d_1) as well as the VOC in the same manner and then an automatically controlled carrier frequency can be obtained without any external control. That is, when the Ierr and Idev are changed, a gm value of the OTA is changed so that the oscillated frequency can be changed.

The frequency correction controller (a_2) includes the error current generator (a_1) and deviation current generator (a_3), and outputs Ierr and Idev of the two circuit blocks (a_1 and a_4) are added in an adder (a_5) and then output as a correction control signal (a_2).

Here, the error current generator (a_1) generates the error Ierr by the voltage/current converter (a_9) by way of a Phase Lock Loop (PLL) block consisted of an automatic frequency detector (a_6), a frequency divider (a_7) and an oscillator (a_8) after receiving a synchronization signal fH externally. Further, the deviation current generator (a_3) generates the deviation current Idev by way of a feedback clamping circuit (a_10) receiving the synchronization signal fH and a video signal, a band gap reference circuit (a_11) and a mutual conductance amplifiers (c_1 and c_2) as a voltage/current converter.

Figure 10:
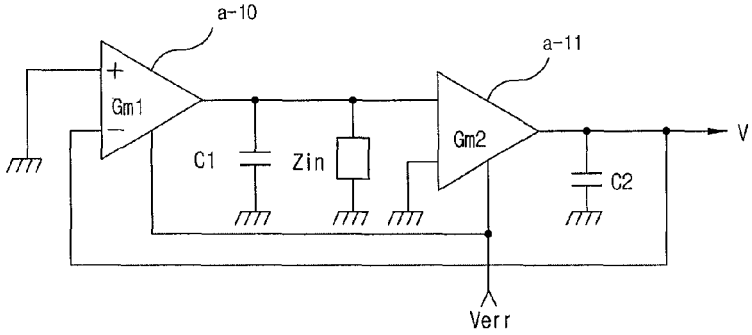
FIG. 10 is a view showing a detailed configuration of a VOC shown in FIG. 4.
Figure 11:
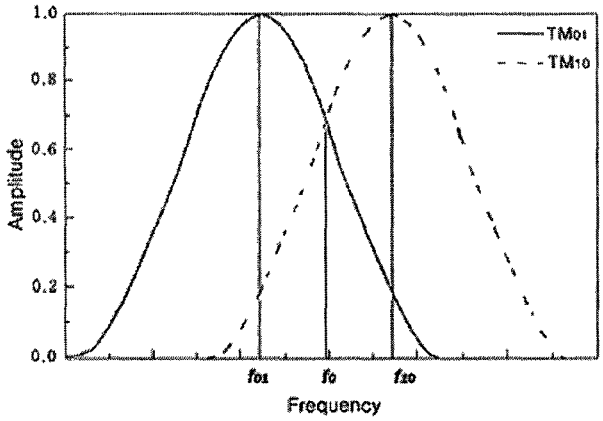
FIG. 11 shows waveforms for explaining operations of a PLL shown in FIG. 4.
Figure 12:
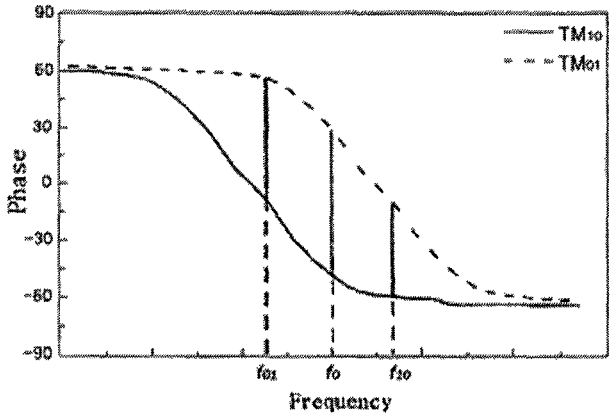
FIG. 12 shows waveforms for explaining operations of a PLL shown in FIG. 4.
Figure 13:
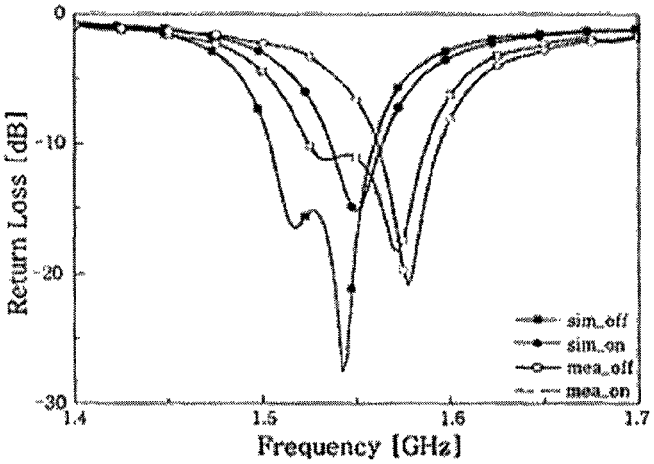
FIG. 13 shows reflective loss result in simulation test and experiment for explaining operations of a PLL shown in FIG. 4.
Figure 14:
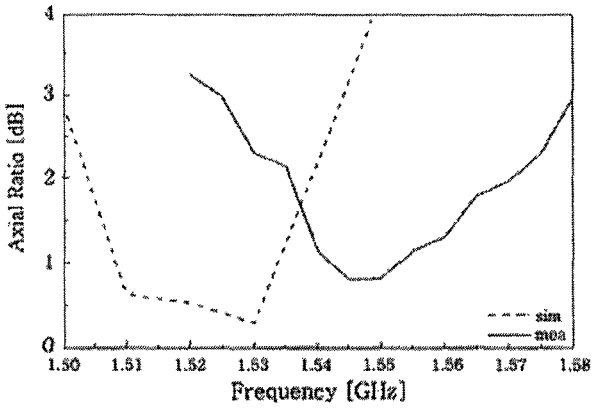
FIG. 14 shows axis ratio bandwidth result in simulation test and experiment for explaining operations of a PLL shown in FIG. 4.

FIG. 10 is a view showing a detailed configuration of a VOC shown in FIG. 4.

Figure 6:
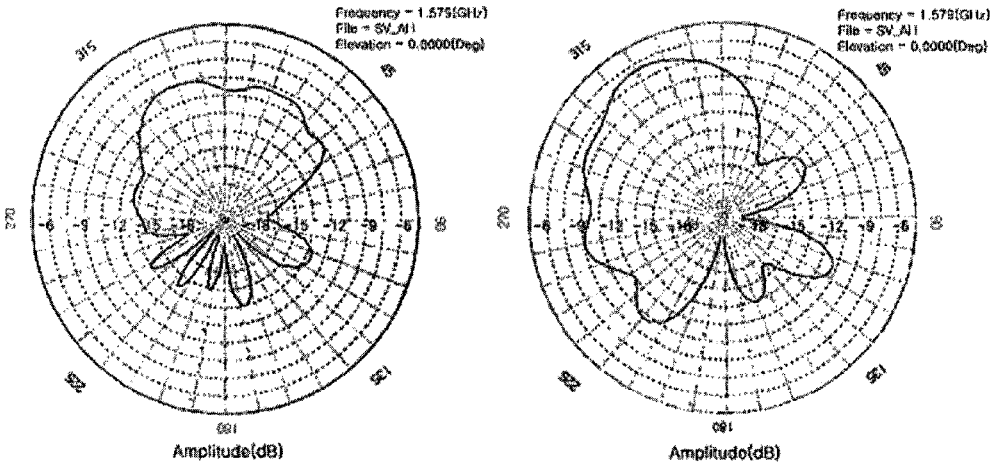
FIG. 6 shows radiation patterns of GPS antenna in accordance with an embodiment of the present invention.
Figure 7:
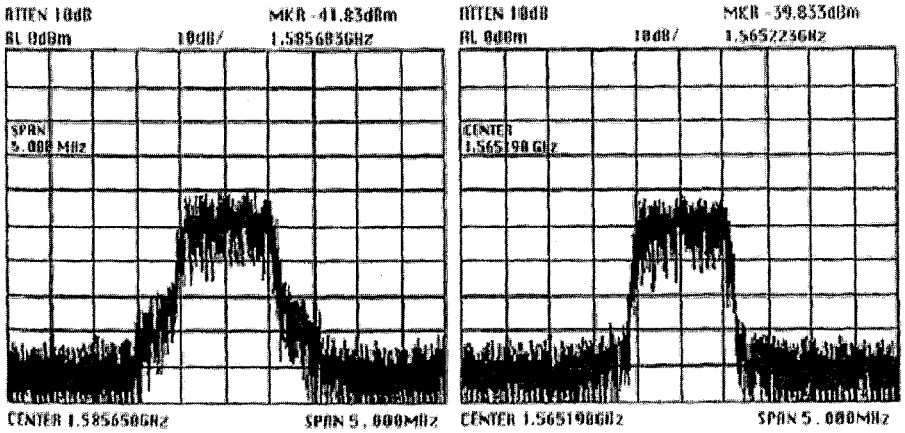
FIG. 7 shows output after changing central frequency in accordance with an embodiment of the present invention.
Figure 8:
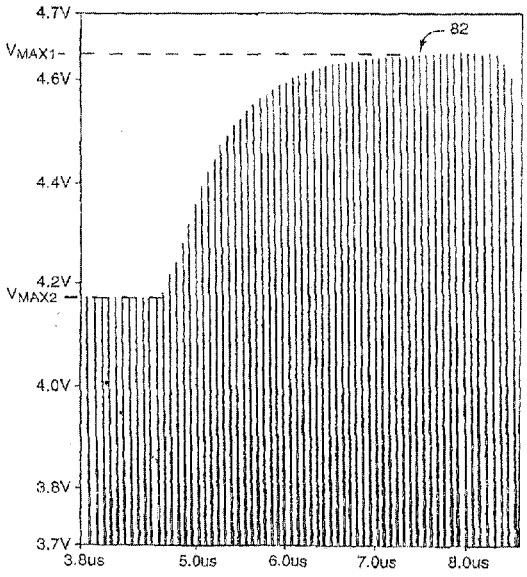
FIG. 8 is a view explaining a procedure for modulating a frequency band 130 dBm of a signal intensity in accordance with an embodiment of the present invention.

A VOC (b_3) outputting 320 fH frequency shown in FIG. 6 is configured to have first and second mutual conductance amplifiers (c_1 and c_2) as shown in FIG. 10. The mutual conductance amplifiers (c_1 and c_2) have a high degree of freedom since it is a combination of unit circuit elements having a high independence. It is proper to control the freedom since an oscillation frequency by changing the mutual conductance. Further, it uniformly maintains a property of device such as a resistance and controls a plurality of filters at a time.

Since the oscillator (b_3) is configured as the mutual conductance amplifiers (c_1 and c_2) having the properties described above, the VOC (b_3) of the 320 fH and the change of the oscillation frequency which is configured in the frequency modulator (d_1) of FIG. 5 to be described below are same relatively.

The error current generator (a_1) basically has a PLL configuration, and the oscillation frequency of VOC (b_3) has a frequency of 5.04 MHz, for example. A fH frequency signal of the signal is applied to an automatic frequency detection circuit (b_1) through an 1/320 fH frequency divider and compared with a fH synchronization signal applied externally so that there occurs an error voltage Verr corresponding, to a mismatched phase difference. The error voltage Verr is applied to the VOC (b_1) again so that it regularly oscillates at 5.04 MHz. The error voltage Verr is applied to the voltage/current converter (b_4) as well as the VOC (b_1) of the 320 fH so that it is connected to the frequency modulator (d_1), where the error voltage Verr is converted and outputted as the corresponding current by the voltage/current converter (b_4) and there occurs an error current Ierr.

It makes the generator having the same configuration as the VOC in the frequency modulator (d_1) oscillate correctly, where the frequency depends on application products, for example, 3.4 MHz.

It is needed to accomplish the object of the present invention, meaning that a carrier frequency of the frequency modulator (d_1) can be automatically controlled externally.

FIGS. 11 to 14 show waveforms for explaining operations of a PLL shown in FIG. 4.

The PLL needs the VOC. Particularly, in the PLL in the error current generator (a_1), the oscillator (b_3) which receives the error voltage as the VOC and outputs a corresponding frequency signal has a configuration including a detailed FBC circuit in FIG. 4 of FIG. 8 and the mutual conductance amplifier OTA (c_1 and c_2) shown in FIG. 15.

In the conventional circuit using the PLL including the VOC, an oscillation circuit of the VOC oscillator and frequency oscillator is configured as passive devices R and C so that a control level of the oscillation frequency is reduced. Further, while it is needed to newly configure an oscillator to oscillate a frequency of 3.4 MHz, it is overcome by employing an OTA circuit that can be converted in a frequency extension and modulation at a frequency band (130 dBm). As a result, although it is not easy to detect a correct error voltage Verr since a phase of a high frequency signal such as 3.4 MHz is compared, the phase comparison is performed with one which is formed in the frequency extension and modulation process at a frequency band (130 dBm) being a frequency lower than the fH of 15.625 MHz (which is a little amount) so that it is possible, to compare the phase precisely. Further, a circuit which can control a frequency shift of the frequency modulation circuit is added so that there also is a function to control the frequency modulation.

Figure 15:
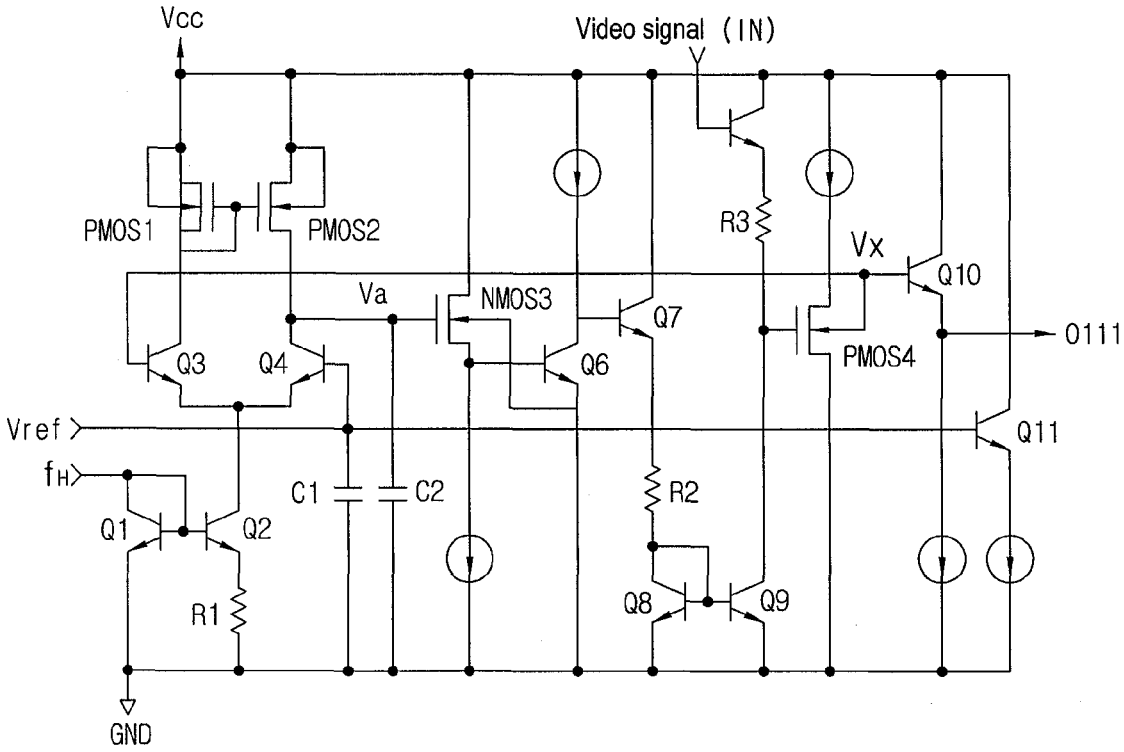
FIG. 15 is a view showing a detailed configuration of a FBC circuit shown in FIG. 4.
Figure 16:
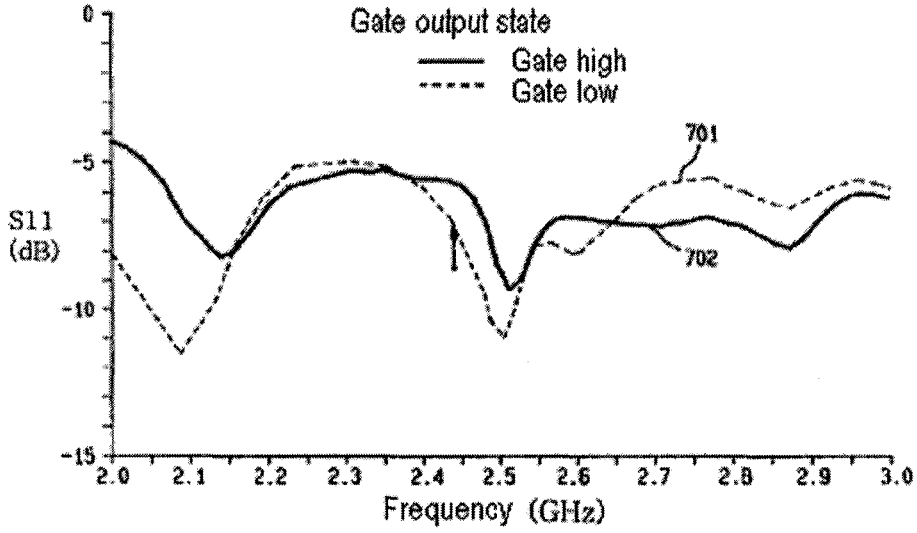
FIG. 16 shows output waveform 1 of an FCC circuit.

FIG. 15 is a view showing a detailed configuration of a FBC circuit shown in FIG. 4.

Referring to FIG. 4, it is shown that a modulated signal which has a wave of condensation and rarefaction according to its level correspondingly to an input video signal is obtained. Here, a corresponding frequency according to a level of the video signal is represented concretely, and particularly a dark clip area having the lowest level and a white clip having the highest level area are represented. FIG. 15 schematically shows a frequency value corresponding to the video signal level with the FBC circuit by integrating the above described ones. That is, it shows that the dark clip 75% level is frequency modulated to 2.65 MHz, for example.

FIGS. 16 to 19 show output waveforms of an FCC circuit.

The VOC oscillation frequency of 320 fH is inputted to the 1/320 fH counter which is generally configured as a flip flop and occurs the fH, and the signal countered down to the 1/320 is compared with a reference fH signal of FIG. 9(*a*) in an automatic frequency detection circuit (b_1). The error voltage Verr is obtained with a well known method as follows and it will be briefly described.

Figure 17:
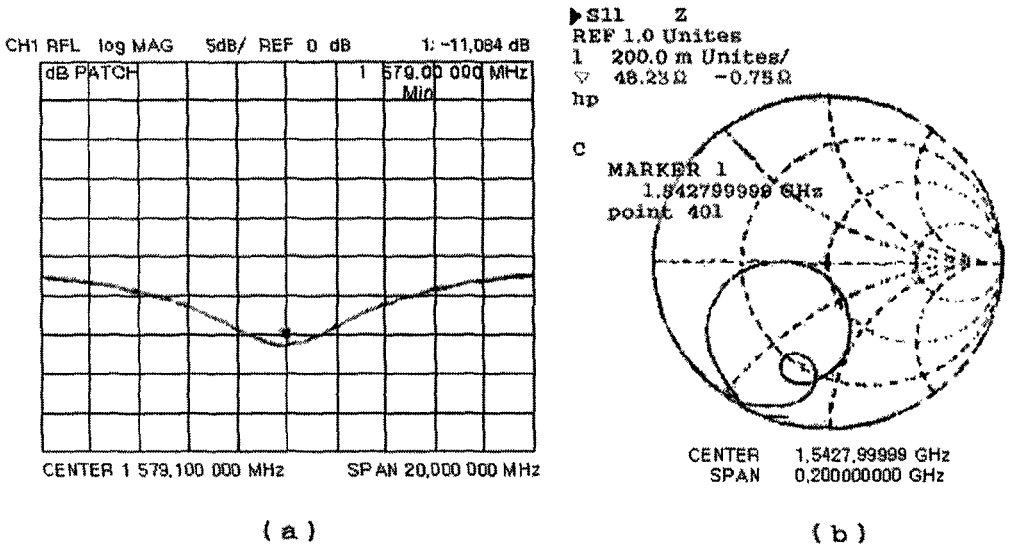
FIG. 17 shows output waveform 2 of an FCC circuit.

First, a H-pulse having a duty cycle 60% where an equivalence pulse period of a composite synchronization is made like one obtained in FIG. 17.

Figure 18:
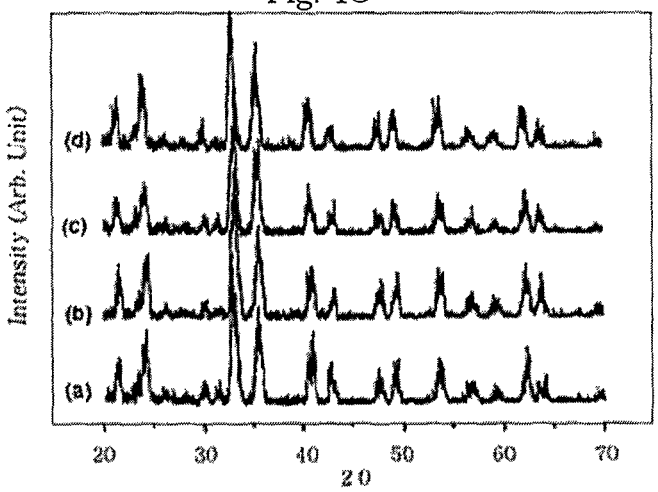
FIG. 18 shows output waveform 3 of an FCC circuit.
Figure 19:
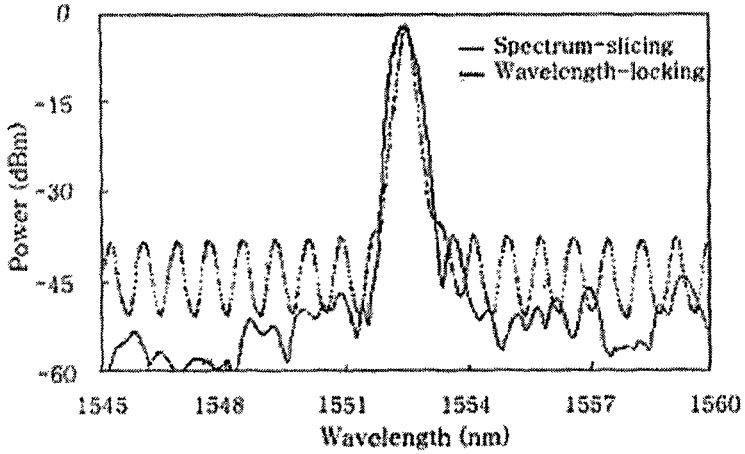
FIG. 19 shows output waveform 4 of an FCC circuit.

Next, while an output of the FCC circuit is frequency divided by 1/320, a gate pulse for detecting the PLL is made as FIG. 18. The pulse signal is gated with the H-pulse so as to obtain the detection output as shown in FIG. 19, and the detection output is integrated in an integrator so that there occurs an error voltage Verr.

The error voltage Verr controls an oscillation frequency of the VOC (b_3). For example, when an initial VOC oscillation frequency is low, a period of a gate pulse shown in FIG. 18 is extended and an upper portion of the detection output shown in FIG. 9(*d*) is extended, so that the output of the integrator becomes high and then an oscillation frequency of the VOC (b_3) is increased. Accordingly, the detection output (FIG. 19) is inputted to the frequency modulator (d_1) having the same configuration as the VOC (b_3) through the voltage/current converter (b_4) and controls the oscillation frequency by the change of the VOC (b_3) so that it is possible to make an oscillation at the designed oscillation frequency.

Meanwhile, before the video signal is applied to the circuit in FIG. 1, a sync-tip is arranged in a predetermined potential. The arranged video signal generates a current Idev proportional to a magnitude of a signal inputted through the voltage/current converter (b_4), and the obtained current Idev is added to the error current Ierr to control the carrier frequency so that it controls the frequency shift of the frequency modulator (d_1). That is, the sync-tip portion of the video signal is modulated as 3.4 MHz and a white portion is modulated as 4.4 MHz, and it means that a frequency modulation circuit of a signal intensity which has a sync-tip control circuit portion of the video signal to automatically and regularly control a carrier frequency of a carrier frequency of the frequency modulation circuit for recording the frequency signal on the magnetization record media is formed in the process of frequency extension and modulation at the frequency band (130 dBm).

Figure 20:
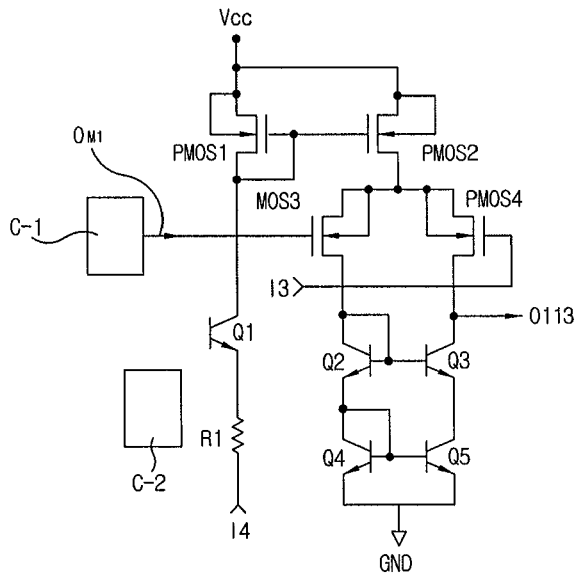
FIG. 20 is a detailed circuit diagram of a mutual conductance amplifier.

FIG. 20 is a detailed circuit diagram of a mutual conductance amplifier.

As shown in FIG. 20, the oscillator (b_3) is configured to pass through a first mutual conductance amplifier (c_1) which receives an output Vout of the oscillator (b_3), the output of the first mutual conductance amplifier (c_1) passing through a condenser C1 and an impedance circuit Zim, and a second mutual conductance amplifier (c_2), and applied to another condenser C2 connected to an output of the second mutual conductance amplifier (c_2). The final, output Vout is obtained from the condenser C2.

Figure 21:
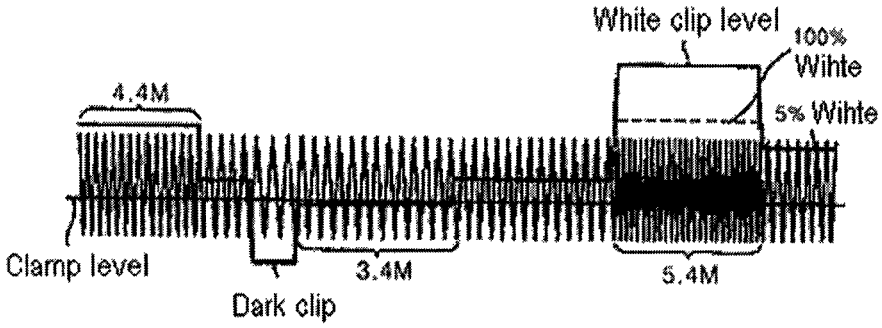
FIG. 21 is a block diagram showing an embodiment of an output waveform in accordance with the present invention.

FIG. 21 is a block diagram showing an embodiment of an output waveform in accordance with the present invention.

Figure 22:
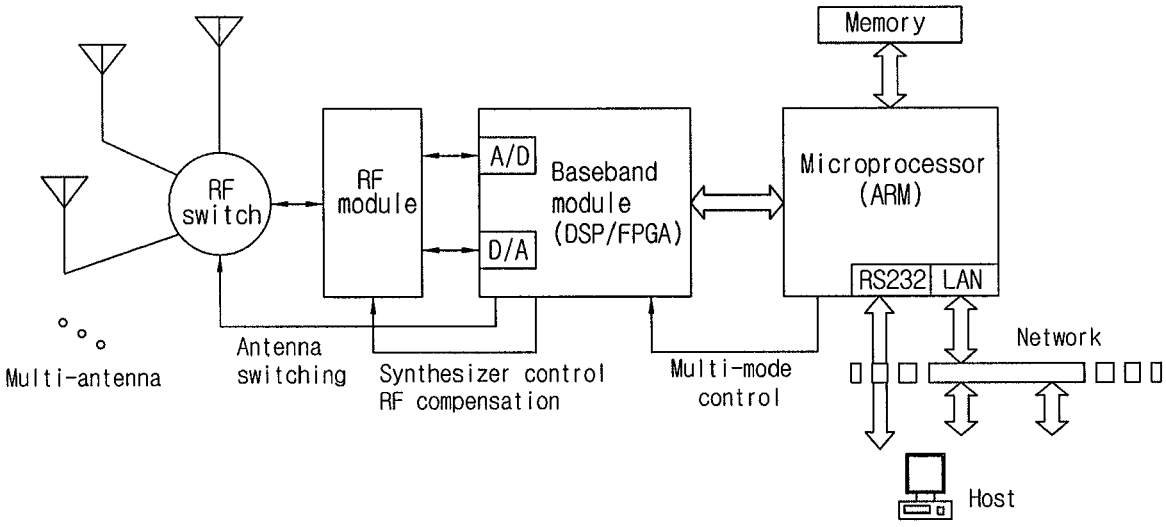
FIG. 22 is a schematic diagram of an RFID system using a GPS terminal in accordance with the present invention.
Figure 23:
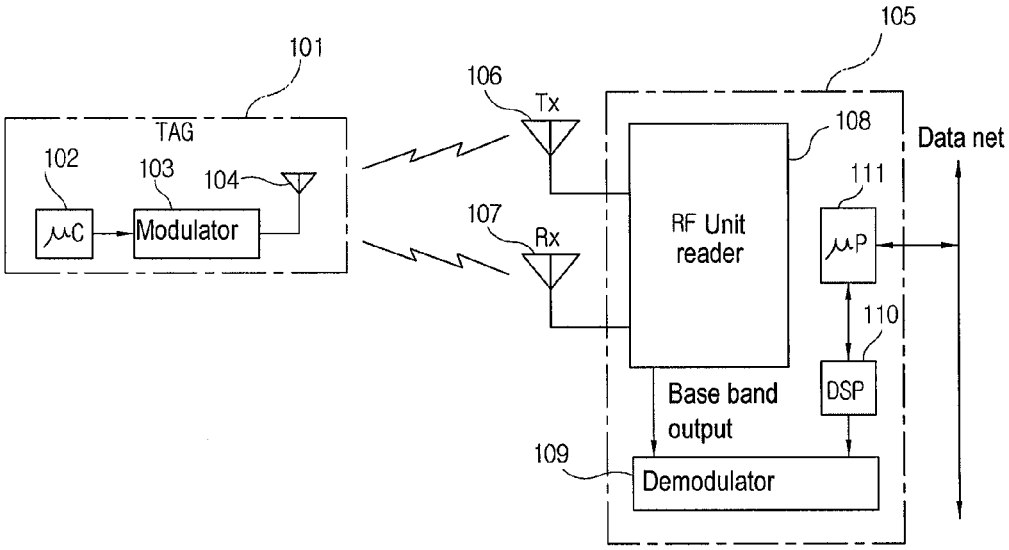
FIG. 23 is a block diagram showing an embodiment of a radio frequency RFID system shown in FIG. 22.
Figure 24:
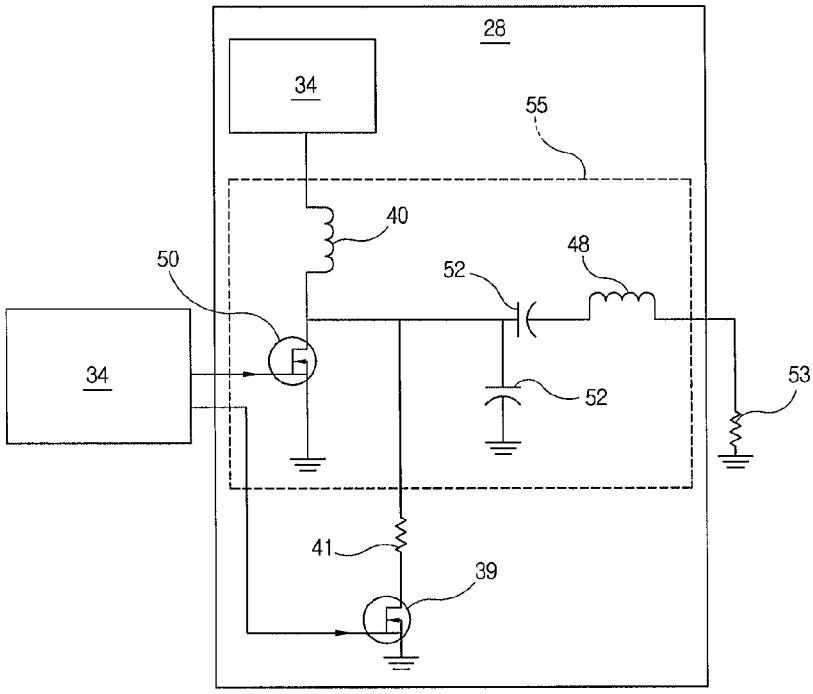
FIG. 24 is a schematic diagram showing an embodiment of an amplifier used in an RFID reader shown in FIG. 22.
Figure 25:
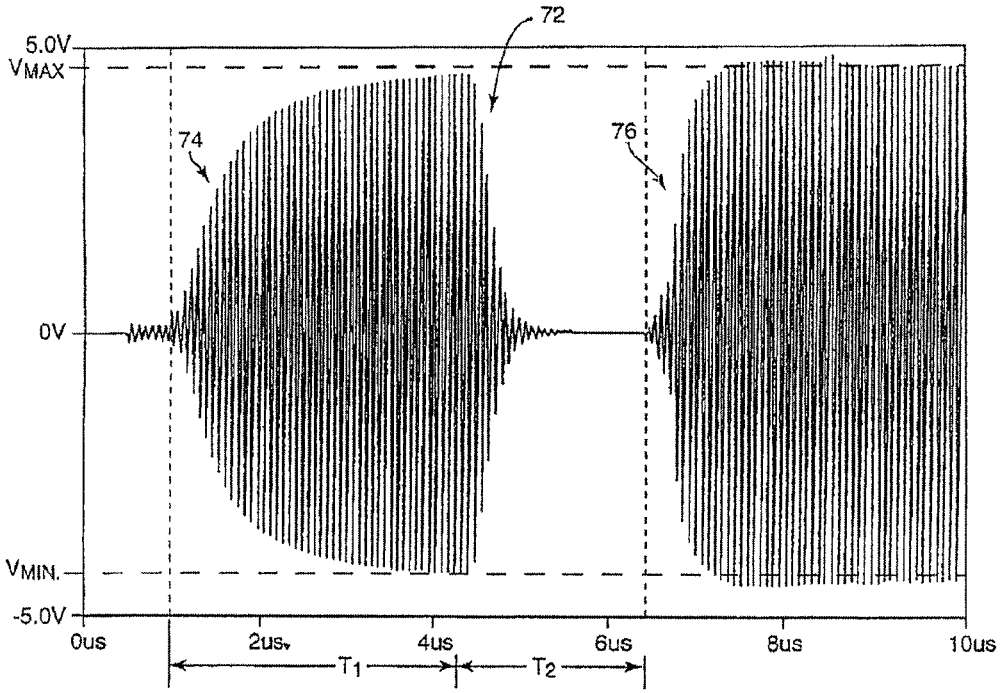
FIG. 25 is a graph showing an embodiment of an amplitude modulated signal shown in FIG. 22.

First, referring to the FIGS. 22 and 23, a schematic view of an electronic tag read system using the GPS terminal in accordance with the present invention and a first embodiment of a wireless frequency method are described. Further, FIGS. 24 and 25 depict a schematic diagram showing an embodiment of an amplifier used in an RFID reader and a graph showing an amplitude modulated signal, both being properly employed in each embodiment. In each embodiment, an embodiment of a case using an electronic tag of a frequency inductance method will be described with reference to the accompanying drawings.

INDUSTRIAL APPLICABILITY

A complex multifunction system of a frequency band (130 dBm) frequency extension modulation of a GPS terminal in a life jacket in accordance of the present invention is comprised of a body including a front plate which transmits and receives a frequency transferred from the GPS terminal in a life jacket in a process of introducing and sharing a coupling scheme with interspace-VLBI in frequency band 130 dBm, and a rear plate which is in contact with a tag of an HDX frequency extension modulation, a head unit for attaching an iris on a head of the body and supporting a frequency propagation amplification transmission of a microstrip patch antenna and a location based service attached to a middle portion of the front plate of the body or a head unit, having a function of transmitting an emergency rescue signal and converting the signal into a multi-language voice information service, wherein a modulation of radio wave propagation and a frequency propagation amplification are performed in the body and the head unit.

The invention claimed is:

1. A complex multifunction system of a frequency band (130 dBm) frequency extension modulation of a GPS terminal in a life jacket, comprising:

a body including a front plate, which transmits and receives a frequency transferred from the GPS terminal in the life jacket in a process of introducing and sharing a coupling scheme with interspace-VLBI in frequency band 130 dBm, and a rear plate which is in contact with a tag of an HDX frequency extension modulation;

a head unit for attaching an iris on a head of the body and supporting a frequency propagation amplification transmission of a microstrip patch antenna; and a location based service attached to a middle portion of the front plate of the body or a head unit, having a function of transmitting an emergency rescue signal and converting the signal into a multilanguage voice information service, wherein a modulation of radio wave propagation and a frequency propagation amplification are performed in the body and the head unit.

2. The complex multifunction system according to claim 1, wherein the body is comprised of the front plate which transmits and receives a frequency transferred from the GPS terminal in the life jacket in a process of introducing and sharing a coupling scheme with interspace-VLBI in frequency band 130 dBm, and the rear plate which is in contact with a tag of an HDX frequency extension modulation, the rear plate including a first sensor contact and a second sensor contact; wherein the head has an iris attached on the head of the body and supports a frequency propagation amplification transmission of the microstrip patch antenna.

3. The complex multifunction system according to claim 1, wherein a frequency modulator in which a modulation is performed in a radio wave amplification transmission method remotely used in a frequency of frequency band 130 dBm requested in the GPS terminal in the life jacket and has an oscillator having the same configuration as the VCO, has a frequency shift keying/carrier frequency revision control circuit comprised of an automatic frequency detection circuit for phase comparing with a fixed frequency signal whose frequency is lower than a carrier frequency and an output of the voltage control oscillator (VCO) which oscillates in a frequency which is multiple times of the frequency with a signal divided in multiple times, a VCO whose input is an error voltage of the output of the frequency detection circuit, an error current generator having a voltage/power converter for converting an output error power of the PLL (Phase Locked Loop) including a frequency divider for dividing a high frequency of the VCO, a feedback clamping (FBC) circuit for receiving the low fixed frequency signal, an input signal to be converted in frequency and a reference voltage determining a clamping level and then clamping the input signal, and an adder for adding an error current and a deviation current, where the frequency of the input signal is modulated in a set carrier frequency.

4. The complex multifunction system according to claim 1, wherein a chip material of the GPS terminal in the life jacket is so adapted that a victim can wear an active tag Radio Frequency Identification (RFID) on the rear plate in the HDX radio wave propagation scheme using the frequency band 130 dBm.

5. The complex multifunction system according to claim 1, wherein an iris is attached to the micro-strip patch antenna inserted into the GPS terminal in the life jacket, and the frequency where the patch is converted into a three dimension configuration is processed in a radio wave amplification scheme using the frequency band 130 dBm remotely.

6. The complex multifunction system according to claim 1, wherein the frequency of the emergency rescue signal transmitted from the GPS terminal in the life jacket is converted in a multilanguage voice information service scheme using the location based service which is a GIS core technology formed in a complex function.

* * * * *